US005944110A

United States Patent [19]

Watts et al.

[11] Patent Number: 5,944,110

[45] Date of Patent: Aug. 31, 1999

[54] VARIABLE BORE RAM PACKER FOR A RAM TYPE BLOWOUT PREVENTER

[75] Inventors: Gerald D. Watts, Hempstead; Theodore F. Griffin, Houston, both of Tex.

[73] Assignee: Cooper Cameron Corporation, Houston, Tex.

[21] Appl. No.: 08/927,194

[22] Filed: Sep. 11, 1997

[51] Int. Cl.[6] ..... E21B 33/06

[52] U.S. Cl. ..... 166/320; 251/1.3; 251/214

[58] Field of Search ..... 166/85.4, 320; 251/1.1, 1.3, 214

[56] References Cited

U.S. PATENT DOCUMENTS

| | | | |
|---|---|---|---|
| 3,915,424 | 10/1975 | LeRouax | 251/1 |
| 3,915,425 | 10/1975 | LeRouax | 251/1 |
| 3,915,426 | 10/1975 | LeRouax | 251/1 |
| 4,229,012 | 10/1980 | Williams, III | 277/127 |
| 4,265,424 | 5/1981 | Jones | 251/1 A |
| 4,332,367 | 6/1982 | Nelson | 251/1 A |
| 4,444,404 | 4/1984 | Parks, Jr. | 277/235 R |
| 4,456,215 | 6/1984 | Bishop et al. | 251/1 B |
| 4,461,448 | 7/1984 | Huey et al. | 251/1 B |
| 4,518,144 | 5/1985 | Vicic et al. | 251/1 |
| 4,550,895 | 11/1985 | Shaffer | 251/1.3 |
| 4,553,730 | 11/1985 | Vicic | 251/1.3 |
| 4,647,002 | 3/1987 | Crutchfield | 251/1.3 |
| 5,005,802 | 4/1991 | McWhorter et al. | 251/1.3 |
| 5,127,623 | 7/1992 | McDugle | 251/1.3 |
| 5,251,870 | 10/1993 | Ward | 251/1.3 |
| 5,294,088 | 3/1994 | McWhorter et al. | 251/1.3 |
| 5,333,832 | 8/1994 | Bartholomew et al. | 251/1.3 |
| 5,405,467 | 4/1995 | Young et al. | 156/91 |

*Primary Examiner*—Roger Schoeppel
*Attorney, Agent, or Firm*—Jackie Lee Duke

[57] ABSTRACT

A variable bore ram packer designed for use in a standard ram-type blowout preventer used in oil and gas drilling operations is disclosed. The variable bore ram packer includes top and bottom second plates having a central semi-circular opening which is sized to fit closely about the largest diameter pipe the variable bore ram packer will seal against. Anti-extrusion plates having a smaller central arcuate opening sized to fit closely the smallest diameter pipe the variable bore ram packer will seal are attached to the underside of the top plate by guide screws. The guide screws extend through slots in the top plates which control the motion of the guide screws and hence the anti-extrusion plates as the anti-extrusion plates move and seat against different diameter tubular members. A packer member of elastomeric material having a central semi-circular opening sized to fit closely the smallest diameter pipe the variable bore ram packer will seal is molded between the top plate and anti-extrusion plates and lower plate to form a unitary structure. A radially disposed cavity is molded in the packer adjacent the anti-extrusion plates to minimize damage to the packer as it moves radially and seals against different diameter tubular members.

18 Claims, 5 Drawing Sheets

VARIABLE BORE RAM PACKER FOR A RAM TYPE BLOWOUT PREVENTER

BACKGROUND OF THE INVENTION

1. Field of the Invention

This invention relates to an improved variable bore ram packer for a ram-type blowout preventer used in oil and gas drilling operations. Ram-type blowout preventers are part of a pressure control system used in oil and gas drilling operations to control unexpected well bore pressure spikes or "kicks" as they are commonly referred to in the industry.

The blowout preventer has a body with a vertical bore and a pair of laterally disposed opposing bonnet assemblies. Each bonnet assembly includes a piston which is laterally moveable within the bonnet assembly by pressurized hydraulic fluid. Replaceable sealing elements called "packers" are mounted on the ends of the pistons which extend into the blowout preventer bore. When these pistons are moved to a closed position, commonly referred to as "closing the blowout preventer" or "closing the rams", the vertical bore of the blowout preventer is sealed and the "kick" is contained. These "packers" are available in a variety of configurations designed to seal the blowout preventer bore when the opposing pistons are moved to their closed position. One type of packer has ends designed to seal around pipe of a specific size in the blowout preventer bore when the blowout preventer is "closed." Other rams are configured to seal around a range of pipe sizes. It is the type designed to seal around a range of pipe sizes, called variable bore ram packers to which the present invention is directed.

The ram packers form a pressure tight seal during a kick until the well bore pressure can be controlled. The well bore pressure can reach several thousand pounds per square inch during a "kick." Each ram packer has a semicircular opening in its front face to form a seal around 180° of the outer periphery of the pipe. When the rams are closed as described above, the opposing ram packers meet and seal the entire 360° periphery of the pipe.

Additionally, the variable bore ram packer is required to seal against the drill pipe during a "stripping" operation. During a stripping operation, the drill pipe is pulled from the well bore with the blowout preventer closed against the drill pipe. This results in enormous wear and tear on the ram packer, particularly the elastomeric sealing element. In an effort to minimize the tearing and loss of mass of the elastomeric sealing element, numerous modifications and additions to the ram packer and particularly the elastomeric sealing element in ram-type blowout preventers have been used. Problems associated with these modifications and additions to the variable bore ram packers include excessive loss of mass of the elastomeric seal element, expensive to manufacture and maintain and requiring special oversized blowout preventer rams to accept the variable bore ram packers. The variable bore ram packer of the current invention offers a substantial improvement by offering a simple, easy to manufacture variable bore ram packer which accommodates a range of pipe sizes, minimizes wear and tear of the elastomeric seal element and is useable in standard size blowout preventer rams.

2. Description of Related Art

Various types of variable bore ram packer designs have been shown and used.

U.S. Pat. No. 3,915,424 to R. K. LeRouax shows an early version of a variable bore ram packer. This apparatus utilizes a plurality of annular segments which use interlocking edges and shoulders to form anti-extrusion members. These anti-extrusion members allow radial and circumferential movement of the elastomeric sealing element to which they are bonded. As the elastomeric sealing element moves to seal around different size tubular members, the anti-extrusion members move also to conform to the diameter of the tubular member and reduce extrusion of the elastomeric sealing element. U.S. Pat. Nos. 3,915,425 and 3,915,426 to R. K. LeRouax and U.S. Pat. No. 4,444,404 to G. C. Parks, Jr., apply this same technology again by varying the shape and method of interlocking the anti-extrusion members.

U.S. Pat. No. 4,229,012 to B. C. Williams, III, discloses another type of variable bore packer for a ram type blowout preventer utilizing irising elements embedded in the elastomeric sealing element to operate like a camera shutter. The irising elements include triangular shaped upper and lower plates connected by a rib. The irising elements are designed and positioned within the elastomeric sealing element to support the sealing element as it closes on different sized tubular members. A similar concept is shown in U.S. Pat. No. 4,332,367 to N. A. Nelson in which the anti-extrusion elements are tapered rectangularly shaped upper and lower plates connected by a rib which are designed to move radially and reduce sealing element extrusion.

As variable bore ram packers seal against different size tubular members, the elastomeric sealing element undergoes considerable deformation which can lead to tearing and severe damage to the elastomeric sealing element. Various patents have disclosed the use of voids or recesses in the elastomeric sealing element to minimize damage. Chief among these are U.S. Pat. No. 4,265,424 to M. R. Jones, U.S. Pat. No. 4,456,215 to T. R. Bishop et al., U.S. Pat. No. 4,461,448 to W. Huey et al. and U.S. Pat. No. 4,550,895 to D. U. Shaffer.

Another consideration in the design of variable bore ram packers is whether the elastomeric sealing element should be flush with the front edge of packer or extending slightly outwardly. Examples of variable ram packers with the elastomeric sealing element extending outwardly are shown in U.S. Pat. No. 4,647,002 to M. K. Crutchfield and U.S. Pat. No. 5,127,623 to G. L. McDugle. These configurations do not lend themselves to long packer life.

A final group of variable bore ram packers utilizes a series of arcuate segments stacked vertically, with a set of arcuate segments for each of the pipe sizes to be sealed against. U.S. Pat. Nos. 5,005,802 and 5,294,088 to D. J. McWhorter et al. typify these designs. While these designs seal well on different sized tubular members, the stacking of the arcuate segments requires the use of a special blowout preventer ram to accommodate the additional height.

SUMMARY OF THE INVENTION

The variable bore ram packer of the present invention is designed for use in a standard ram-type blowout preventer used in oil and gas drilling operations. The blowout preventer has a body with an axial bore, a pair of opposing bonnet assemblies and a pair of opposing rams laterally moveable within the bonnet assemblies by a pressurized fluid source to control flow of well fluids through the blowout preventer body axial bore. The variable bore ram packer includes top and bottom second plates having a central semi-circular opening which is sized to fit closely about the largest diameter pipe that the variable bore ram packer will seal against. Anti-extrusion plates having a smaller central arcuate opening sized to fit closely the smallest diameter pipe the variable bore ram packer will seal are attached to the underside of the top plate by guide screws. The guide screws extend through slots in the top plates which control the motion of the guide screws and hence the anti-extrusion plates as the anti-extrusion plates move and seat against different diameter tubular members. A packer member of elastomeric material having a central semi-circular opening sized to fit closely the smallest diameter pipe that the variable bore ram packer will seal is molded between the top plate and anti-extrusion plates and lower plate to form a unitary structure. A radially disposed cavity is molded or machined in the packer adjacent the anti-extrusion plates to minimize damage to the packer as the packer moves radially and seals against different diameter tubular members.

A principal object of the present invention is to provide a variable bore ram packer that allows sealing over a wide range of tubular member diameters without requiring the use of special oversized blowout preventer rams.

Another object of the present invention is to provide a variable bore ram packer that will reliably maintain a seal against different sized tubular members while minimizing damage to the elastomeric sealing element of the packer.

A final object of the present invention is to provide a variable bore ram packer that is significantly more compact than those currently in use.

These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENT

Figure 1:
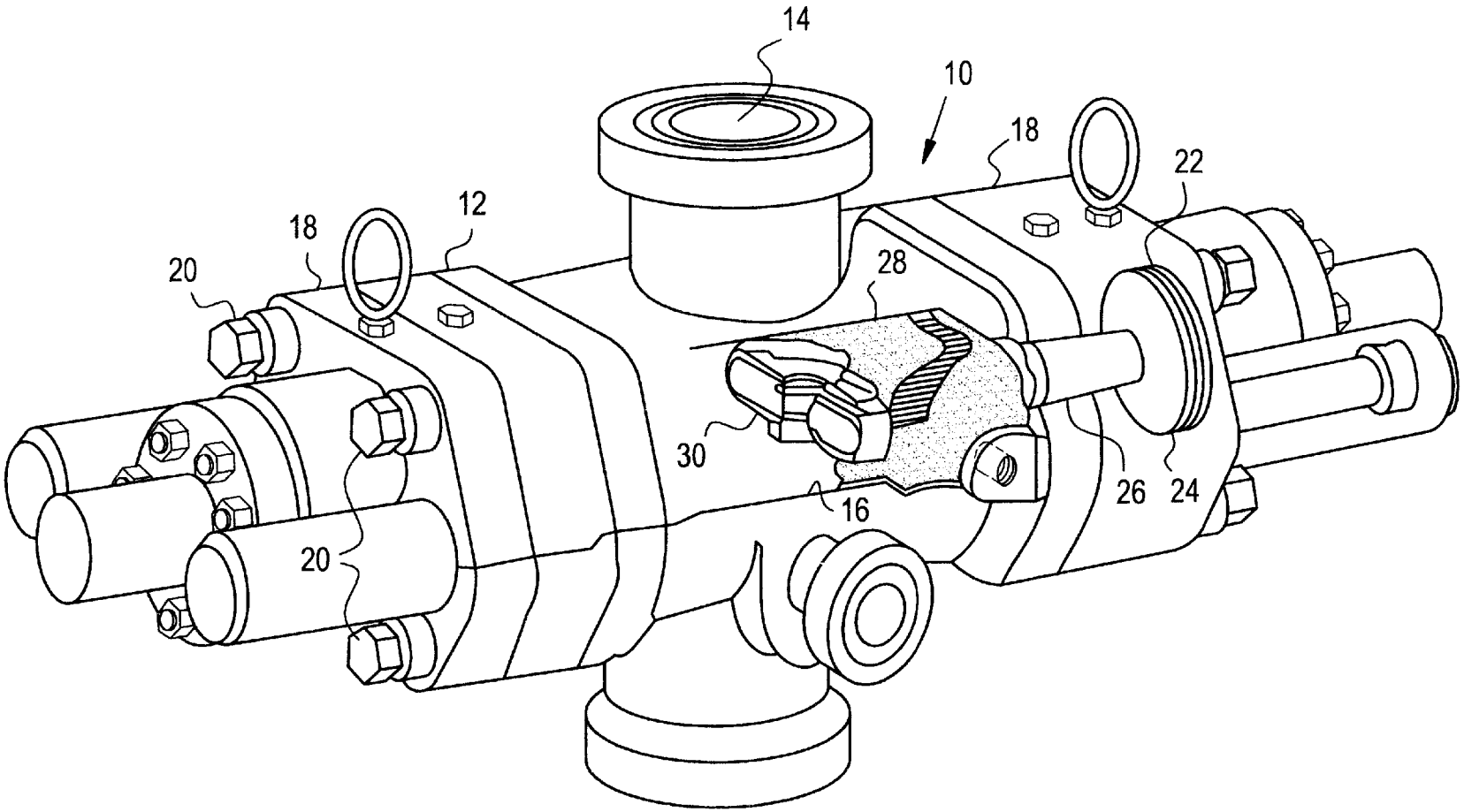
FIG. 1 is a perspective view with a cutaway section of the variable bore ram packer of the present invention installed in a typical ram-type blowout preventer used in oil and gas drilling operations.

With reference to the drawings, and particularly to FIG. 1, an isometric view of a ram type blowout preventer 10 used in oil and gas drilling operations is shown. The ram type blowout preventer 10 includes a body or housing 12 with a vertical bore 14 and laterally disposed ram guideways 16. Bonnet assemblies 18 are mounted to the body 12 with studs 20 and aligned with laterally disposed guideways 16. Each bonnet assembly 18 includes an actuation means 22, including a piston 24 and connecting rod 26 (shown in phantom). While only one guideway 16 and actuation means 22 is shown, it is understood by those of ordinary skill in the art that there is a pair of opposed guideways 16 and actuation means 22. Each connecting rod 26 is connected to a ram 28 which includes the variable bore ram packer 30 of the present invention. Actuation means 22 allows ram and variable bore ram packer 30 to be reciprocated within guideways 16 or "opening and closing the rams" as it is referred to in the industry.

Figure 2:
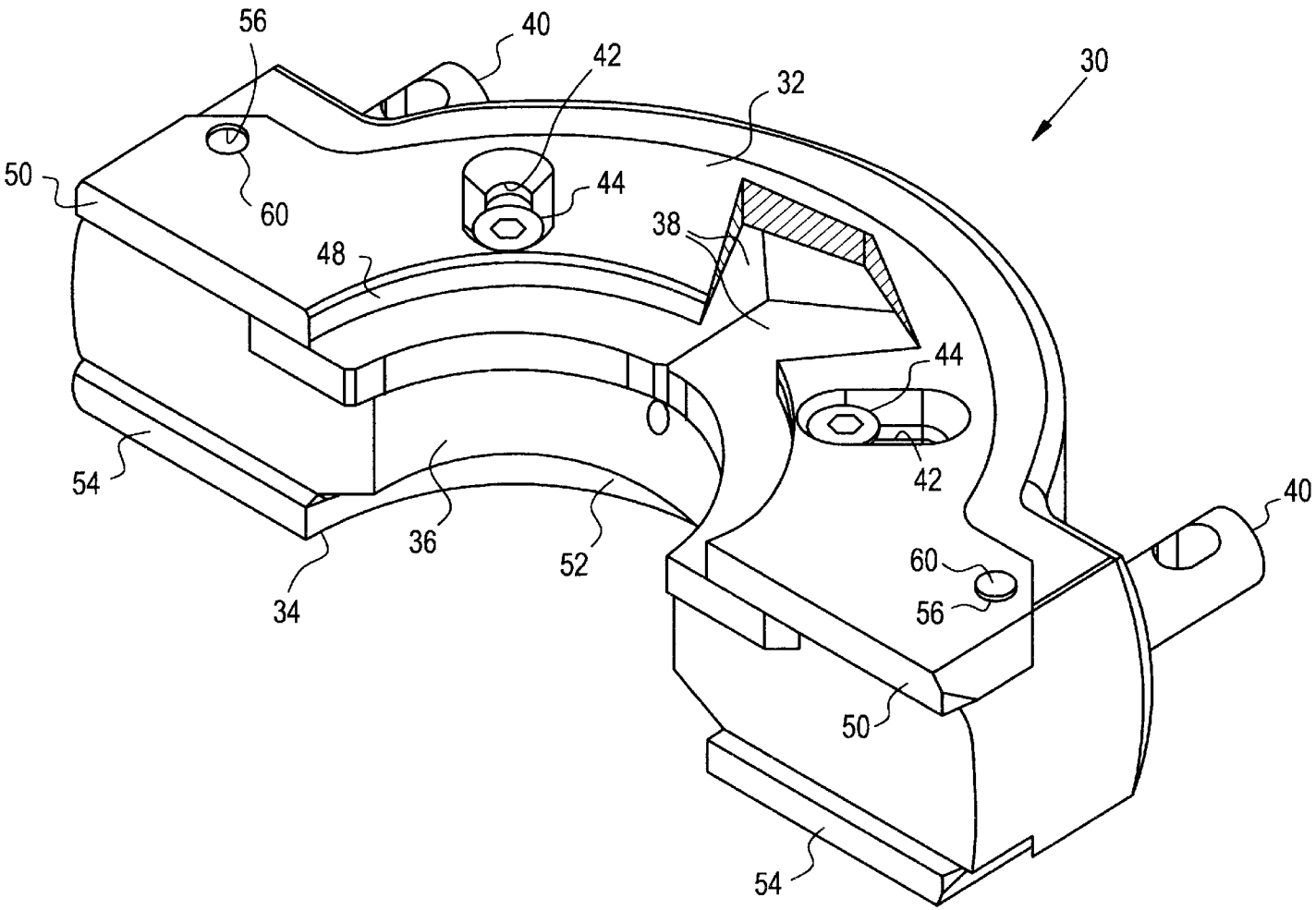
FIG. 2 is a perspective view of the assembled variable bore ram packer.
Figure 3:
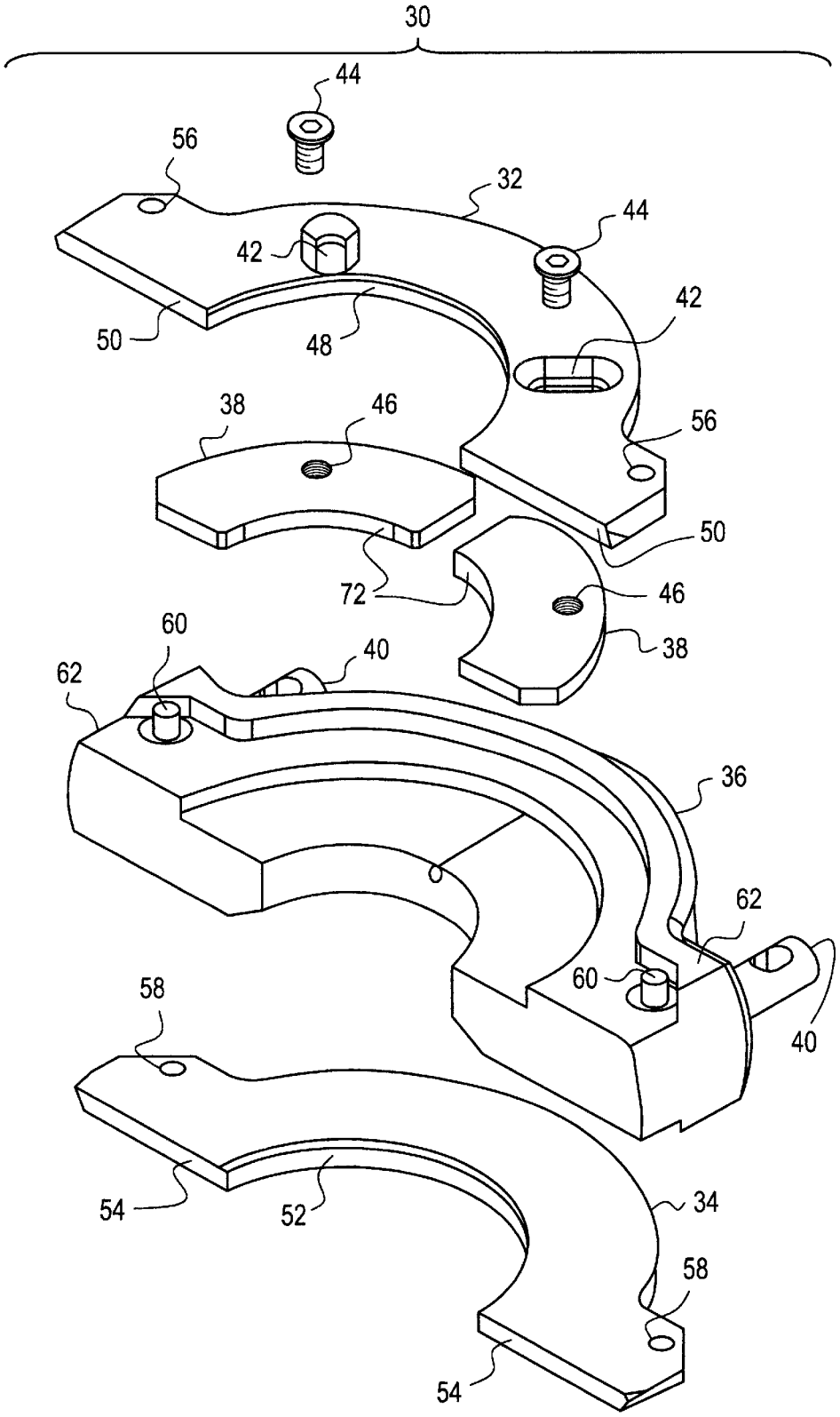
FIG. 3 is an exploded view of the variable bore ram packer.

Variable bore ram packer 30 is shown assembled in FIG. 2 and in an exploded view in FIG. 3 to aid in understanding the relationship between the parts. Variable bore ram packer 30 includes top plate 32 and bottom plate 34 with a packer member 36 and an anti-extrusion means or insert segments 38 molded into one unitary structure. Variable bore ram packer 30 also includes packer pins 40 molded into the structure for connecting the variable bore ram packer 30 to the ram 28. Top plate 32 includes a plurality of guide slots 42 through which guide screws 44 extend. Guide screws 44 are threaded into threaded holes 46 in insert segments 38. Movement of guide screws 44 within guide slots 42 acts to control the motion of insert segments 38 in a manner to be described more fully hereinafter.

Top plate 32 includes a semi-circular opening or recess 48 and leading edges 50. Bottom plate 34 is similarly shaped with a semi-circular opening or recess 52 sized to match recess 48 and leading edges 54. Holes 56 and 58 in top plate 32 and bottom plate 34, respectively, receive the vertical leg 60 of packer pins 40 to assure semi-circular openings or recesses 48 and 52 are coaxial. Semi-circular openings or recesses 48 and 52 are sized to fit closely about the largest diameter tubular member the variable bore ram packer 30 will seal against in a manner to be described hereinafter.

Figure 4:
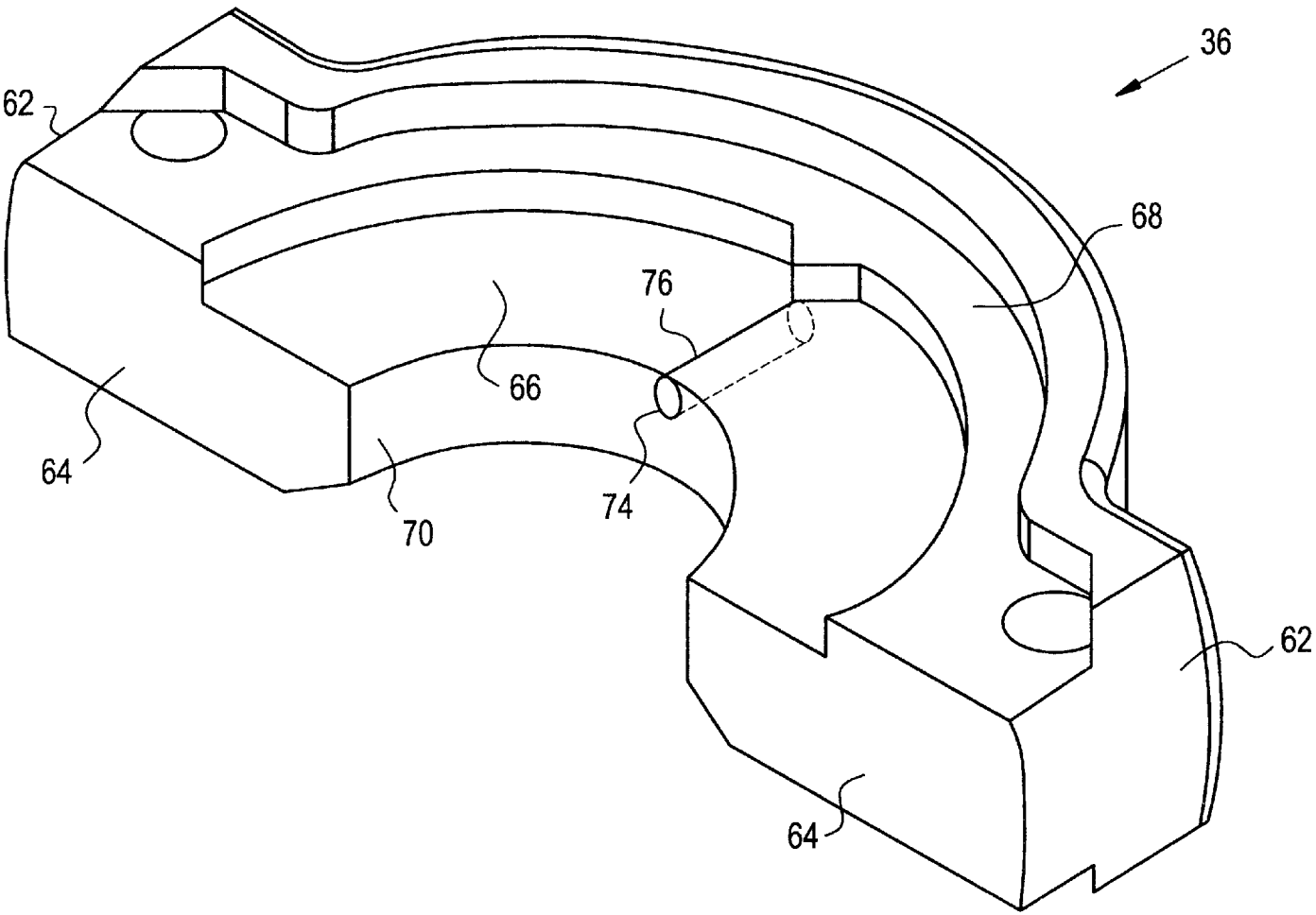
FIG. 4 is a perspective view of the elastomeric sealing element of the variable bore ram packer.

Referring to FIG. 4, packer member 36 is a generally semi-circular shape with end lugs 62 and front faces 64 and molded of an elastomeric material. Packer member 36 has semi-circular recesses 66 and 68 formed on its upper face which are coaxial with semi-circular opening 70. Recess 66 forms a ledge into which insert segments 38 are molded. Insert segments 38 have a smaller central arcuate opening 72 sized to match that of semi-circular opening 70 and fit closely about the smallest diameter tubular member the variable bore ram packer 30 will seal against in a manner to be described hereinafter. A radially disposed cavity 74 is molded in packer 36 adjacent the edges of insert segments to minimize damage to the elastomeric material of packer 36 as the insert segments 38 move and seat against different diameter tubular members. Alternatively, radially disposed cavity 74 may be machined in packer 36. The upper edge 76 of radially disposed cavity 74 is cut to allow radially disposed cavity 74 to flex open and shut. Recess 68 forms a ledge into which top plate 32 is molded. Top plate 32 has a larger semi-circular opening or recess 48 as noted above coaxial with semi-circular recesses 66 and 68 and central arcuate opening 72 of insert segments 38.

Figure 5:
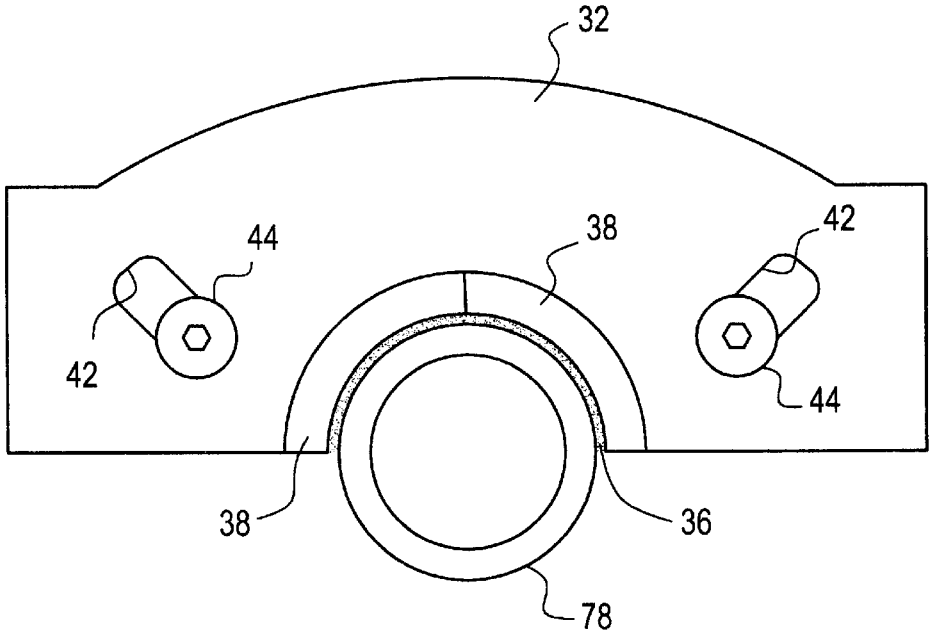
FIG. 5 is a partial sectional view of the variable bore ram packer sealed against the smallest diameter pipe that the variable bore ram packer will seal.
Figure 6:
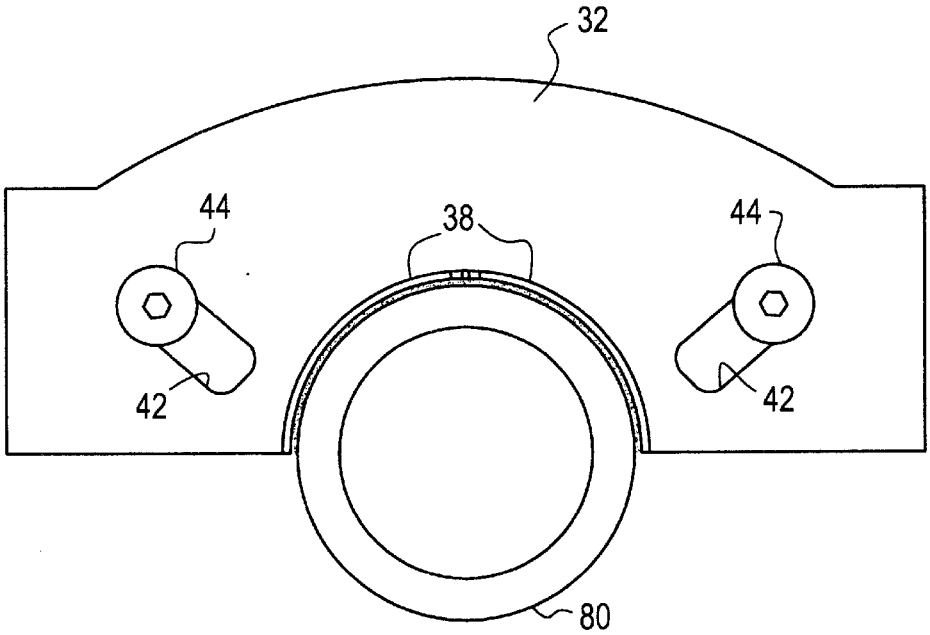
FIG. 6 is a partial sectional view of the variable bore ram packer sealed against the largest diameter pipe that the variable bore ram packer will seal.

Referring now to FIGS. 5 and 6, operation of variable bore ram packer 30 in sealing against different sized diameter members is shown. In FIG. 5, variable bore ram packer 30 is shown sealing against the smallest diameter member it is designed to accommodate. Smaller diameter drill pipe or tubular member 78 is positioned within the bore 14 of ram type blowout preventer 10 with its axis substantially coaxial with that of ram type blowout preventer 10. Actuation means 22 is operated to move variable bore ram packer 30 to the sealing position shown in FIG. 5. In this position, packer 36 is sealing tightly against tubular member 78 and insert segments 38 are in a forward position to prevent extrusion of packer 36 by well bore pressure acting from below.

In FIG. 6, variable bore ram packer 30 is shown sealing against the largest diameter member it is designed to accommodate. Larger diameter drill pipe or tubular member 80 is positioned within the bore 14 of ram type blowout preventer 10 with its axis substantially coaxial with that of ram type blowout preventer 10. Actuation means 22 has been operated to move variable bore ram packer 30 to the sealing position shown in FIG. 6. In this position, packer 36 is sealing tightly against tubular member 80 as before, but its semi-circular opening 70 has been forced to expand to accommodate the larger diameter tubular member 80. Insert segments 38 have been pushed to their rearmost position with their smaller central arcuate opening 72 expanded to approximate that of semi-circular opening or recess 48 of top plate 32. In this position, top plate 32 and insert segments 38 both function to prevent extrusion of packer 36 by well bore pressure acting from below. The expansion of packer 36 to the position shown in FIG. 6 causes radially disposed cavity 74 to open and aid in the expansion of packer 36 by minimizing the tearing and damage to packer 36.

The construction of our improved variable bore ram packer will be readily understood from the foregoing description and it will be seen that we have provided an improved variable bore ram packer to allow sealing over a wide range of tubular member diameters without requiring the use of special oversized blowout preventer rams.

Additionally, our variable bore ram packer will reliably maintain a seal against different sized tubular members while minimizing damage to the elastomeric sealing element of the packer during operation. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims

What is claimed is:

1. A variable bore packer for a ram-type blowout preventer used in oil and gas drilling operations, for sealing against different diameter tubular members, comprising:

first and second plates having a central semi-circular opening and leading edges;

a plurality of insert segments having a smaller central arcuate opening sized to fit closely about the tubular members and coaxial with said central semi-circular opening of said first and second plates;

a packer member molded of elastomeric material having a smaller central semi-circular opening sized to fit closely about the tubular members and coaxial with said central semi-circular opening of said first and second plates, said packer member including at least one horizontally disposed opening in said packer extending radially outwardly from said smaller central semi-circular opening to an intermediate position between said smaller central semi-circular opening and said packer's outer edge, said horizontally disposed opening adjacent said plurality of insert segments to minimize damage to said elastomeric material of said packer as said plurality of insert segments move and seat against different diameter tubular members;

said plurality of insert segments being disposed between said first plate and said packer member; and said packer member, said first and second plates and said plurality of insert segments being molded into a unitary structure allowing said plurality of insert segments to move and seat against different diameter tubular members to prevent extrusion of said elastomeric material between said first and second plates and the tubular member.

2. A variable bore packer for a ram-type blowout preventer used in oil and gas drilling operations, for sealing against different diameter tubular members according to claim 1, including:

a plurality of packer pins molded in said packer member to connect said variable bore packer to a ram-type blowout preventer.

3. A variable bore packer for a ram-type blowout preventer used in oil and gas drilling operations, for sealing against different diameter tubular members according to claim 2, further including:

a guide means for controlling the motion of said plurality of insert segments as said plurality of insert segments move and seat against different diameter tubular members.

4. A variable bore packer for a ram-type blowout preventer used in oil and gas drilling operations, for sealing against different diameter tubular members according to claim 3, wherein said guide means includes:

a guide screw slidably connecting each said insert segment to said first plate.

5. A variable bore packer for a ram-type blowout preventer used in oil and gas drilling operations, for sealing against different diameter tubular members according to claim 4, wherein:

said first plate includes guide slots therein;

said plurality of insert segments includes threaded holes therein and said threaded holes are aligned with said guide slots; and, said guide screws being received in said guide slots and said threaded holes such that the motion of said plurality of insert segments as said plurality of insert segments move and seat against different diameter tubular members is controlled by said guide screws moving within said slots.

6. A variable bore packer for a ram-type blowout preventer used in oil and gas drilling operations, for sealing against different diameter tubular members according to claim 5, wherein:

said radially disposed cavities in said packer adjacent said plurality of insert segments are of circular cross-section.

7. A variable bore packer for a ram-type blowout preventer used in oil and gas drilling operations, for sealing against different diameter tubular members according to claim 6, wherein:

said plurality of insert segments are substantially 90° arcuate segments having a leading edge and a trailing edge.

8. A variable bore packer for a ram-type blowout preventer used in oil and gas drilling operations, for sealing against different diameter tubular members according to claim 7, wherein:

said leading edge of said insert segments and said leading edge of said first and second plates are coplanar; and, said packer member is radially recessed outwardly from at least one of said leading edges of said insert segments.

9. A variable bore packer for a ram-type blowout preventer used in oil and gas drilling operations, for sealing against different diameter tubular members according to claim 8, wherein:

said second plate has holes formed therein; and, said holes cooperate with said packer pins to maintain said central semi-circular opening of said second plate coaxial with said central semi-circular opening of said first plate.

10. In a ram-type blowout preventer used in oil and gas drilling operations including a body with an axial bore, a pair of opposing bonnet assemblies and a pair of opposing rams laterally moveable within the bonnet assemblies, a variable bore packer for sealing against different diameter tubular members positioned in said ram's front face; the improvement comprising:

top and bottom plates having a central semi-circular opening and leading edges;

a plurality of anti-extrusion plates having a smaller central arcuate opening sized to fit closely about the tubular members and coaxial with said central semi-circular opening of said top and bottom plates;

a packer member molded of elastomeric material having a smaller central semi-circular opening sized to fit closely about the tubular members and coaxial with said central semi-circular opening of said top and bottom plates, said packer member including at least one horizontally disposed opening in said packer extending radially outwardly from said smaller central semi-circular opening to an intermediate position between said smaller central semi-circular opening and said packer's outer edge, said horizontally disposed opening adjacent said plurality of anti-extrusion plates to minimize damage to said elastomeric material of said packer as said plurality of anti-extrusion plates move and seat against different diameter tubular members;

said plurality of anti-extrusion plates being disposed between said top plate and said packer member; and said packer member, said first and second plates and said plurality of anti-extrusion plates being molded into a unitary structure allowing said plurality of anti-extrusion plates to move and seat against different diameter tubular members to prevent extrusion of said elastomeric material between said anti-extrusion plates and the tubular member.

11. In a ram-type blowout preventer used in oil and gas drilling operations as set forth in claim 10, including:

a plurality of packer pins molded in said packer member to connect said variable bore packer to a ram-type, blowout preventer.

12. In ram-type blowout preventer used in oil and gas drilling operations as set forth in claim 11, including:

a guide means for controlling the motion of said plurality of anti-extrusion plates as said plurality of anti-extrusion plates move and seat against different diameter tubular members.

13. In a ram-type blowout preventer used in oil and gas drilling operations as set forth in claim 12, wherein said guide means includes:

a guide screw slidably connecting each said anti-extrusion plate to said top plate.

14. In a ram-type blowout preventer used in oil and gas drilling operations as set forth in claim 13, wherein:

said top plate includes guide slots therein;

said plurality of anti-extrusion plates includes threaded holes therein and said threaded holes are aligned with said guide slots; and, said guide screws being received in said guide slots and said threaded holes such that the motion of said plurality of anti-extrusion plates as said plurality of anti-extrusion plates move and seat against different diameter tubular members is controlled by said guide screws moving within said slots.

15. In a ram-type blowout preventer used in oil and gas drilling operations as set forth in claim 14, wherein:

said radially disposed cavities in said packer adjacent said plurality of anti-extrusion plates are of circular cross-section.

16. In a ram-type blowout preventer used in oil and gas drilling operations as set forth in claim 15, wherein:

said plurality of anti-extrusion plates are substantially 90° arcuate segments having a leading edge and a trailing edge.

17. In a ram-type blowout preventer used in oil and gas drilling operations as set forth in claim 16, wherein:

said leading edge of said anti-extrusion plates and said leading edge of said top and said bottom plates are coplanar; and, said packer member is radially recessed outwardly from at least one of said leading edges of said anti-extrustion plates.

18. In a ram-type blowout preventer used in oil and gas drilling operations as set forth in claim 17, wherein:

said bottom plate has holes formed therein; and, said holes cooperate with said packer pins to maintain said central semi-circular opening of said bottom plate coaxial with said central semi-circular opening of said top plate.

* * * * *